US005836132A

United States Patent [19]

Weathersby

[11] Patent Number: 5,836,132

[45] Date of Patent: Nov. 17, 1998

[54] ANCHOR TEMPLATE

[75] Inventor: Kirby Weathersby, Covington, Ga.

[73] Assignee: E-Z Anchor Bolt Template, Inc., Covington, Ga.

[21] Appl. No.: 791,284

[22] Filed: Jan. 30, 1997

Related U.S. Application Data

[60] Provisional application No. 60/014,920 Apr. 10, 1996.

[51] Int. Cl.[6] ..... E04B 1/38

[52] U.S. Cl. ..... 52/702; 52/295; 52/699; 52/713; 249/93; 249/205; 249/207; 264/35

[58] Field of Search ..... 52/295, 699, 701, 52/702, 703, 704, 713, 296, 297, 298; 249/205, 207, 93, 219.1, 231.9, 210; 33/518, 613, 562; 264/35, 270

[56] References Cited

U.S. PATENT DOCUMENTS

| | | | |
|---|---|---|---|
| 2,378,850 | 6/1945 | Hyre | 33/518 X |
| 3,163,909 | 1/1965 | Williams . | |
| 3,458,184 | 7/1969 | Schlosser | 52/699 |
| 3,552,734 | 1/1971 | Severino et al. . | |
| 3,861,104 | 1/1975 | Boner | 52/713 X |
| 3,960,356 | 6/1976 | Adams . | |
| 3,963,210 | 6/1976 | Macklin . | |
| 3,972,168 | 8/1976 | Allen | 52/713 X |
| 4,261,544 | 4/1981 | Addison . | |
| 4,612,740 | 9/1986 | Yamamoto | 52/713 X |
| 4,614,070 | 9/1986 | Yoland | 52/713 X |
| 4,736,554 | 4/1988 | Tyler . | |
| 5,060,436 | 10/1991 | Delgado, Jr. | 52/295 |
| 5,240,224 | 8/1993 | Adams . | |
| 5,337,534 | 8/1994 | Nasca . | |
| 5,357,721 | 10/1994 | Alvarez | 52/713 X |
| 5,611,179 | 3/1997 | Leek | 52/713 X |
| 5,619,834 | 4/1997 | Chen | 52/713 X |

*Primary Examiner*—Christopher Kent
*Assistant Examiner*—Yvonne Horton-Richardson

[57] ABSTRACT

A reusable anchor bolt template (10) and method for suspending an anchor bolt (56) into a concrete material (53) and adapted to be fastened to a single form element (54) at a top end and a bottom end of the form element (54). The preferred embodiment (10) of a reusable anchor bolt template is comprised of a form plate (11) that engages and rests upon the top portion of the form element (54). Adjustably attached to the form plate (11) is a securing strap (12) for engaging the bottom end of the form element (54), thereby securing the template (10) to the form element (54). Attached to the form plate (11) is a means for suspending an anchor bolt (56) into poured concrete (53), preferably comprising a first and second primary support elements (18, 19) attached in cantilever fashion to the form plate (11). In the preferred embodiment (10), two parallel secondary support members (27, 28) are adjustably attached at each end to the first and second primary support members (18, 19). The first and second secondary support members (27, 28) preferably support one or more support plates (42). In operation, a threaded end of an anchor bolt (56) is inserted into the support plate (42) opening from below. Then, an anchor bolt nut (57) may be threaded down upon the anchor bolt (56) such that the anchor bolt nut (57) rests upon the support plate (12). As such, the anchor bolt (56) is permitted to hang freely from the anchor bolt template (10) and into a concrete material (53).

4 Claims, 3 Drawing Sheets

ANCHOR TEMPLATE

RELATED APPLICATION

This application is based upon, and claims priority to prior-filed provisional application Ser. No. 60/014,920; filed Apr. 10, 1996.

FIELD OF THE INVENTION

The present invention relates generally to an apparatus and method for aiding the placement of anchor bolts in poured concrete and, more particularly, to a reusable anchor bolt template for adjustably suspending an anchor bolt into a concrete material and corresponding method for accomplishing the same.

BACKGROUND OF THE INVENTION

Anchor bolts are commonly used in the construction industry to secure various parts of buildings to a concrete footing or foundation. For example, it is common to use anchor bolts to attach the base plate of a column securely to the concrete foundation. It is also common to secure walls or support beams of a building to the concrete foundation by attaching them to anchor bolts. Use of anchor bolts is particularly important in the construction of metal buildings. In such applications, it is necessary to secure walls and columns to the concrete footing by means of cables and rods attached to the anchor bolts, as well as by direct attachment to the anchor bolts.

An anchor bolt is normally constructed of metal and shaped into a hook at one end. The other end of an anchor bolt is usually threaded such that an appropriately sized nut may be attached thereto. In application, an anchor bolt is inserted, with hook-end down, into a concrete material before the concrete has hardened. A portion of the threaded end of the anchor bolt is left protruding above the top surface of the concrete material. Various parts of the building are attached to the threaded end.

In the placement of anchor bolts, it is critical that the protruding, threaded end be normal to the concrete surface. The distance of the anchor bolt from the edge of the concrete and the distance the anchor bolt protrudes from the concrete surface are also very important characteristics. In fact, building codes often dictate the height of an anchor bolt above the footing.

In an effort to properly position anchor bolts in the concrete footing, there have been attempts in the prior art to develop an effective anchor bolt positioner. Most of these prior art positioners, however, are quite time consuming to secure to the concrete form and position properly. For example, U.S. Pat. No. 5,240,224 to Adams depicts a device that suspends an anchor bolt into a concrete material. The Adams device requires nails to be driven through the holder and into the form element in order to secure the holder. Furthermore, care must be taken with this device to clamp the anchor bolt into the holding jaws and two form elements must be closely parallel in order to use this device. All of these factors yield device which is very complicated and time consuming to use.

Some devices have been developed which attach to a top end of a single form element. For example, U.S. Pat. No. 5,337,534 to Nasca depicts a device that attaches to a top edge of a single form element and allows an anchor bolt to hang from this device into poured concrete. However, this device is not adjustable so as to permit the anchor bolt to be placed at varying distances from the form element.

Additionally, this device still requires some sort of nail or other securing mechanism to hold the positioning device to the form element. Even with a nail driven into the form element, and through the positioning device, the device is still unstable and easily jarred from holding the anchor bolt in an upright position.

Thus, there exists a need in the art for a reusable anchor bolt template and method for suspending a normally disposed anchor bolt into poured concrete material. Such a reusable anchor bolt template and method would overcome the many problems of the prior art and it is to the provision of such an apparatus that the present invention is primarily directed.

SUMMARY OF THE INVENTION

Briefly described, the present invention comprises a reusable anchor bolt template adapted to be fastened to a single form element at a top end and a bottom end of the form element. The template is comprised of an upper form plate which engages and rests upon the top portion of the form element. Attached to this form plate is a securing strap. The securing strap is for engaging the bottom end of the form element, thereby securing the template to the form element. The connection between the form plate and the securing strap should preferably be adjustable in order to accommodate different sizes of form elements.

By grasping the form element on both the top and bottom end, the preferred embodiment of the present invention attaches to the form element very securely without any need for nails or screws. As a result, the template is quickly and easily attached to a form element. Furthermore, the device is very easily removed from the form element after the concrete has hardened. Also important to the present invention is the added stability given to the template by grasping the form element at both top and bottom ends.

Attached to the form plate is a means for suspending anchor bolts below a level of poured concrete. Preferably, this suspending means comprises a primary support member attached in cantilever fashion to the form element. Such a primary support member extends from the form plate, over the area where concrete will be poured.

In a preferred embodiment of the present invention, this primary support member comprises a first primary support element attached in cantilever fashion to the form plate and a second primary support element, parallel to the first primary support element, and also attached in cantilever fashion to the form plate. For greater structural rigidity of the first and second primary support elements, one may attach a slender stabilizing member to ends of the first and second primary support elements not connected to the form plate.

The suspending means further preferably comprises a secondary support element adjustably attached to said first and second primary support elements. Such a secondary support element can comprise two parallel secondary support members attached at a first end to the first primary support element and at a second end to the second primary support element. One or more support plates are adjustably attached to these secondary support members. A support plate preferably comprises a square or rectangular element forming an opening. The opening is preferably sized such that anchor bolts of various sizes can slide through this opening.

In operation, the anchor bolt template is attached to a form element and the threaded end of an anchor bolt is inserted into the support plate opening from below the plate with the threads of the anchor bolt protruding up from the top of the support plate. Then, a nut may be threaded down upon the anchor bolt such that the nut rests upon the support plate and the anchor bolt is suspended from the support plate and into the poured concrete material.

Therefore, an object to the present invention is to provide an anchor bolt template that is quickly attachable to a form element.

Another object of the present invention is to provide an anchor bolt template that may be detached from the form element after use and reused in later concrete projects.

Another object of the present invention is to provide a reusable anchor bolt template that grasps both the top and bottom ends of a form element in order to prevent dislocation of bolts from any jarring of the device.

Yet another object to the present invention is to provide a reusable anchor bolt template that is fully adjustable as to the distance the anchor bolt is positioned from the form element and adjustable as to the anchor bolt's position laterally along the length of the form element.

Another object of the reusable anchor bolt template disclosed herein is to provide an anchor bolt template which can be adjusted to accommodate placing an anchor bolt with respect to a surface poured concrete material.

Other objects, features and advantages of the present invention will be apparent to those skilled in the art. A more thorough understanding of the invention will be gained through a review of the detailed description set forth below, when taken in conjunction with the accompanying drawings, which are briefly described as follows.

DETAILED DESCRIPTION OF THE DRAWINGS

The present invention can be better understood with reference to the following drawings. The drawings are not necessarily to scale, emphasis instead being placed upon clearly illustrating the principles of the present invention. Moreover, like reference numerals designate corresponding parts throughout the several views.

DETAILED DESCRIPTION OF THE PREFERRED EMBODIMENT

Figure 1:
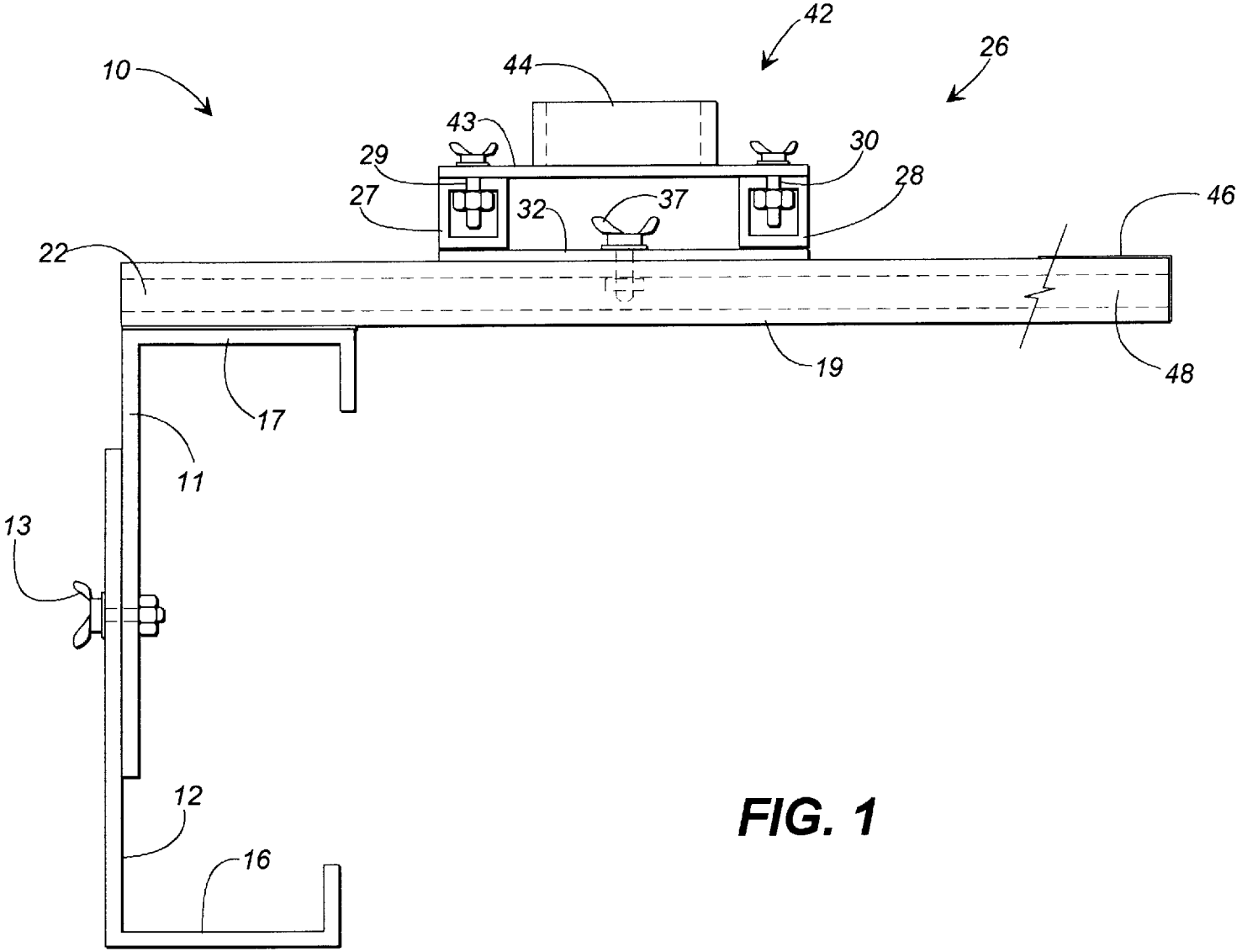
FIG. 1 is a cut-away side view of a reusable anchor bolt template.
Figure 2:
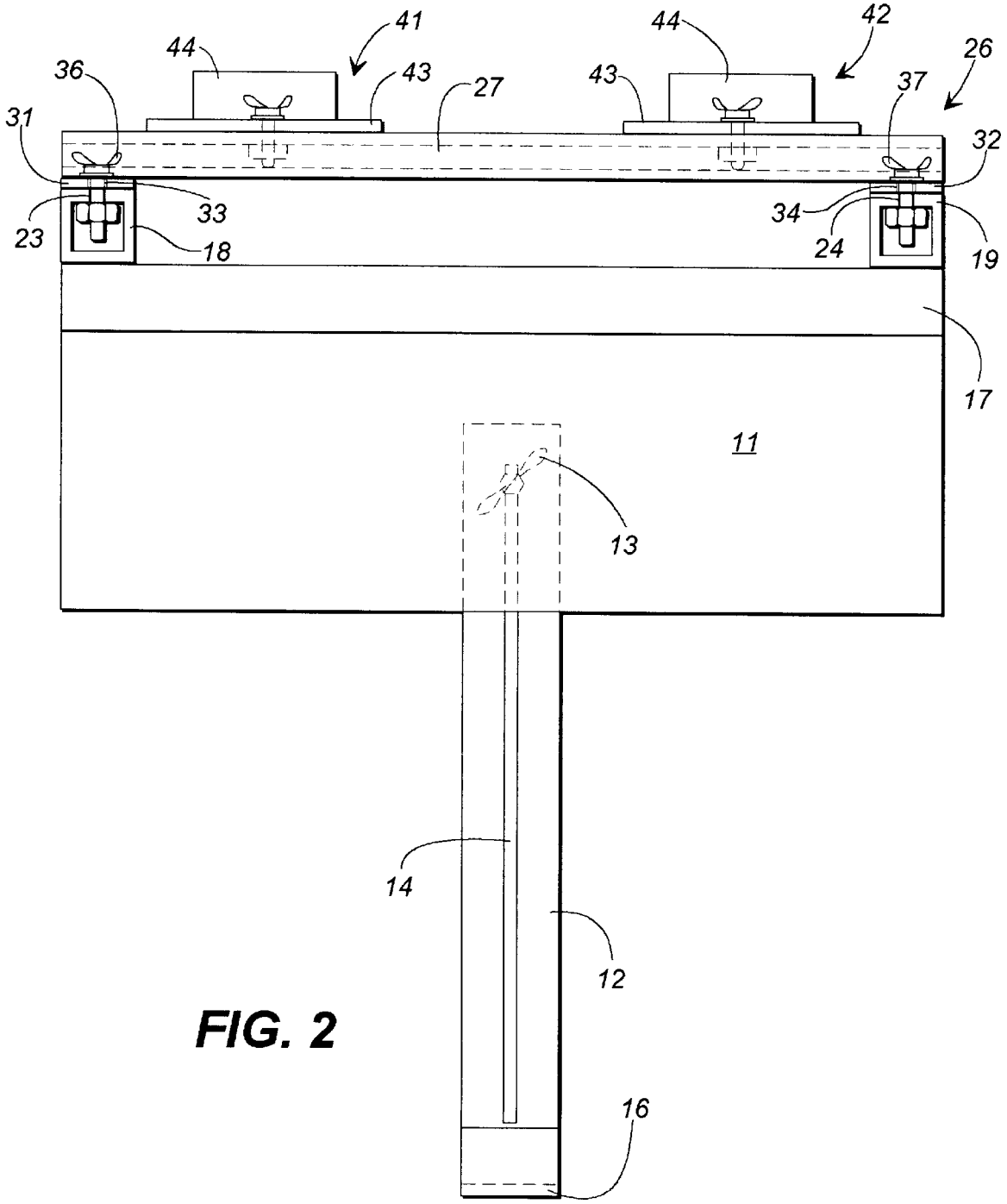
FIG. 2 is a cut-away end view of a reusable anchor bolt template.

The preferred embodiment for a reusable anchor bolt template 10 is depicted in FIG. 1. The preferred embodiment 10 is comprised of a form plate 11 connected to a securing strap 12. The form plate 11 and the securing strap 12 are depicted in FIG. 1 as being connected by a wing nut 13. However, the wing nut 13 depicted is not the only means for attaching the form plate 11 to the securing strap 12. Any suitable means of attachment is meant to be included in the present invention. As best depicted in FIG. 2, the securing strap 12 is preferably a slender member in comparison to the form plate 11. In addition, the securing strap 12 has an elongated slot 14 running vertically along a majority of the length of its longest side. Because of the slot 14, the wing nut 13 may be loosened and the entire securing strap 12 moved with relation to the form plate 11 as desired. This sliding motion permits the distance between the securing strap lower surface 16 and the form plate upper surface 17 to be adjusted in order to accommodated different mounting situations.

In the present invention, the actual dimensions of the securing strap 12 and the form plate 11 can vary within broad perimeters. For example, it may be desirable to have a broad securing strap (not depicted) equal in width to the form plate 11. However, in order to minimize material and fabrication cost, the present, preferred embodiment of the reusable anchor bolt template 10 is as depicted in FIG. 2.

The form plate 11 and the securing strap 12 may be made of any suitably rigid material. By way of example, aluminum, galvanized metal, or rigid plastic would be appropriate. The elements of the preferred embodiment 10 are constructed of a metallic material.

As depicted in FIG. 1, the anchor bolt template 10 is further comprised of two elongated primary support members 18, 19. The first primary support member 18 is depicted in FIG. 1 as attached to the form plate 11 at a proximal end 21 of the primary support member 18. The second primary support member 19, as better depicted in FIG. 2, is parallel to the first primary support member 18 and also connected to the form plate 11 at a proximal end 22 of the second primary support member 19. Any appropriate means of attachment may be used to attach the first primary support member 18 and the second primary support member 19 to the form plate 11. Examples of appropriate methods of attachment are welding, screws, or even glue depending on the material selected to make the elements of the template 10. The primary support members 18, 19 of the preferred embodiment 10 are welded to the form plate 11.

In the preferred embodiment depicted in FIGS. 1 and 2, the first and second primary support members 18, 19 are shaped as elongated rectangular cylinders, with longitudinal slots 23, 24 cut along their entire lengths. Once again, the present invention is not meant to be limited by such a form. However, such a configuration permits a flat surface for attachment of the primary support members 18, 19 to other elements of the template 10.

Mounted atop the first primary support member 18 and the second primary support member 19 is a bolt suspending unit 26. This suspending unit 26 is primarily made up of two parallel secondary support members 27, 28. As depicted in the preferred embodiment, the secondary support members 27, 28 are rectangular cylindrical elements similar in form to the primary support members 18, 19. The secondary support members 27, 28 also have longitudinal slots 29, 30 cut along their entire length. Although not limited to such configuration, forming the primary support members 18, 19 and the secondary support members 27, 28 alike will reduce manufacturing cost of the anchor bolt template 10. Furthermore, as described above, the particular design depicted in FIGS. 1 and 2 permit a great deal of adjustability and also provide a flat surface for attachment.

The secondary support members 27, 28 are disposed perpendicular to the primary support members 18, 19 and sized such that they span the distance from the first primary support member 18 to the second primary support member 19, as depicted in FIG. 2. As depicted best in FIG. 1, the secondary support members 27, 28 do not rest directly upon the primary support members 18, 19. Rather, the secondary support members 27, 28 are securely attached, by some appropriate means, to spacer plates 31, 32 at each end of the secondary support members 27, 28. The spacer plates 31, 32 are rectangular elements of the same width as the primary support members 18, 19 and of a length, as selected by the manufacturer, to correspond to the distance between the first secondary support member 27 and the second secondary support member 28. The length of the spacer plates 31, 32 are not critical to the present invention.

Both spacer plates 31 and 32 should preferably define holes 33, 34 in their center portions. Through these holes 33, 34 wing nuts 36, 37 may be inserted such they protrude below the spacer plates 31, 32. Nuts are then threaded on the wing nuts 36, 37 and the entire bolt suspending unit 26 slidably mounted onto the primary support members 18, 19. Through tightening the wing nuts 36, 37, a person can securely fasten the bolt suspending unit 26 to the primary support members 18, 19. However, one may wish to substitute another appropriate attachment means for the wing nuts 36, 37. Such an obvious modification is intended to be included in the present invention.

Along the top surface of the secondary support members 27, 28 are preferably mounted two support plates 41, 42. The number of support plates is not critical to the present invention. Although not limited to the present configuration, the support plates 41, 42 depicted in the figures have a substantially rectangular base unit 43 and a collar element 44 attached thereto. On each side of the base unit 43, there should preferably be holes through which wing nuts, or other attachment devices, can pass. Similar to the attachment of the entire bolt suspending unit 26 to the primary support members 18, 19, the support plates 41, 42 may be adjustably attached by their base unit 43 to the secondary support members 27, 28. The wing nuts are inserted through the holes in the base unit 43 and then self-locking nuts are threaded onto the wing nuts. The entire support plate 41 is then slidably mounted onto the secondary support members 27, 28 by permitting the wing nuts to pass into the slots 29, 30 as depicted in FIG. 1.

The collar element 44 can be sized such that anchor bolts of a range of sizes may pass therethrough. Preferably, however, several collar elements 44 should be manufactured for use with the same reusable anchor bolt template 10 such that each collar element 44 is sized to fit an anchor bolt of a specific size. Therefore, a user of the anchor bolt template 10 can interchange collar elements 44 of different sizes to accommodate anchor bolts of different sizes. However, the collar element 44 used should be narrow enough such that an anchor bolt nut threaded onto the anchor bolt selected will not pass through an opening in the collar element 44.

Although not required of the present invention, FIG. 1 depicts an angled stabilizing member 46 made of two rectangular elements attached to each primary support member 18, 19 at a distal end 47, 48 of each primary support member 18, 19. This stabilizing member 46 gives greater rigidity to the entire anchor bolt template 10 and limits the lateral travel of the bolt suspending unit 26 along the primary support members 18, 19.

Figure 3:
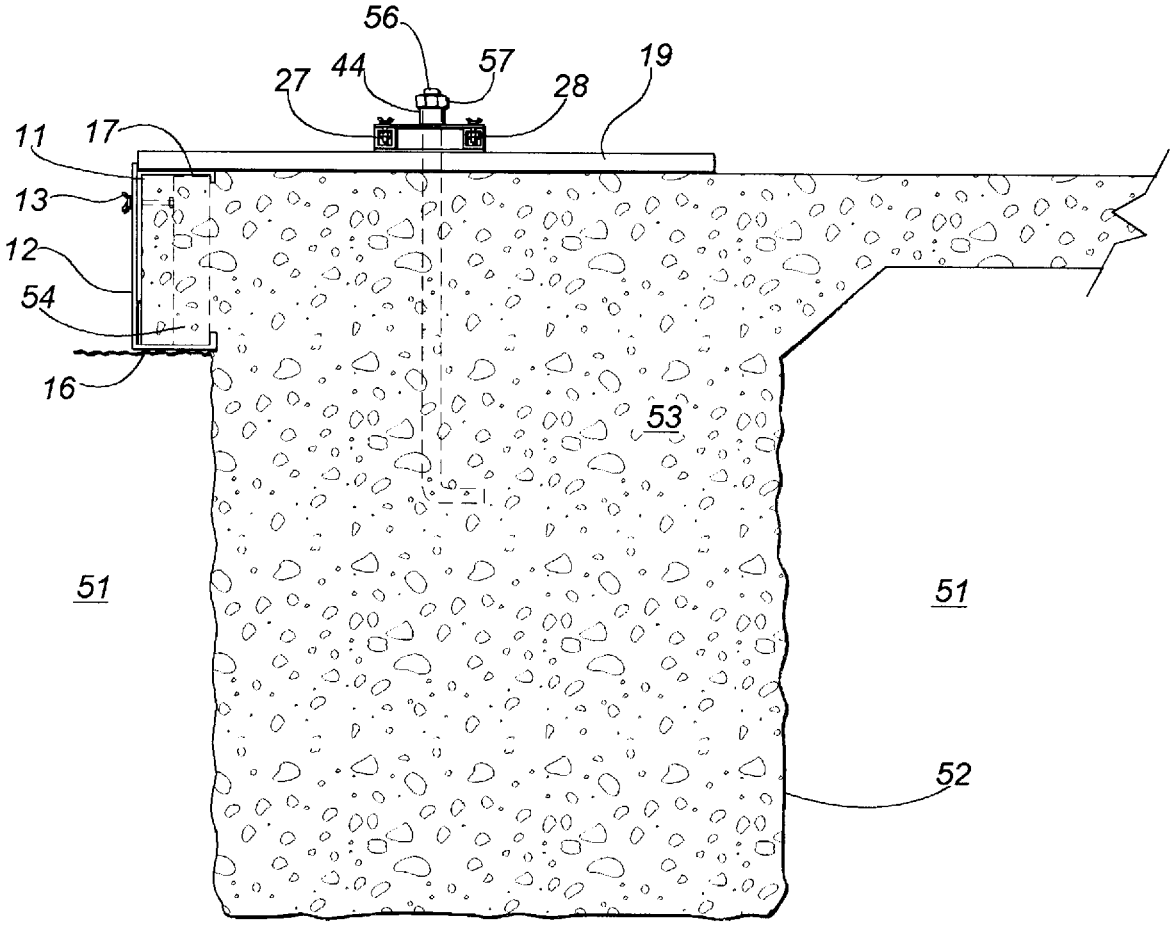
FIG. 3 is a cut-away side view of a reusable anchor bolt template in operation grasping a form element and suspending an anchor bolt into a poured concrete material.

FIG. 3 depicts the preferred embodiment for an anchor bolt template 10 in operation. In the particular use shown in FIG. 3, a ground surface 51 defines a ditch 52 into which concrete material 53 has been poured. Above the surface of the ground 51, and also supporting the concrete 53, is a form element 54. The material out of which the form element 54 is constructed does not matter to the present invention. As noted above, the anchor bolt template 10 is fastened to the form element 54 by allowing the form plate upper surface 17 to rest upon the top of the form element 54. The securing strap lower surface 16, at the same time, engages the bottom surface of the form element 54. When the top and bottom surface of the form element 54 are engaged securely as shown in FIG. 3, the wing nut 13 can be tightened. Thereby, the form plate 11 and the securing strap 12 are not permitted to move from their positions on the form element 54. Furthermore, because of the slot 14 in the securing strap 13, the size of the form element 54 is not important.

Before the concrete material 53 was poured into the form, an anchor bolt 56 was allowed to pass up through the collar element 44 of the support plate 41. Then, an anchor bolt nut 57 was threaded onto the anchor bolt 56. In this way, the anchor bolt 56 was suspended from the primary support members 18, 19 substantially perpendicular to these primary support members 18, 19. Then, the concrete material 53 was allowed to fill the ditch 52 and rise to the top of the form element 54.

After the concrete 53 hardens, the anchor bolt nut 57 is removed from the anchor bolt 53. Then, the wing nut 13 securing the template 10 to the form element 54 is loosened. As the lower surface 16 of the securing strap 12 is released from the bottom end of the form element 54, the entire anchor bolt template 10 may be removed from the form element 54 and reused.

It would be apparent to one skilled in the art that many variations and modifications may be made to the preferred embodiment as described above without substantially departing from the principals of the present invention. All such variations and modifications are intended to be included herein and are within the scope of the present invention, as set forth in the following claims.

It is claimed:

1. A reusable anchor bolt template adapted to be fastened to a form element having top and bottom ends, wherein said template comprises:

(a) a form plate adapted to engage the top end of the form element;

(b) a first primary support element attached in cantilever fashion to said form plate;

(c) a second primary support element arranged parallel to said fist primary support element and attached in cantilever fashion to said form plate;

(d) a securing strap adjustably connected to said form plate and engaging the bottom end of the form element for releasably securing the form plate to the form element;

(e) a primary support member attached in cantilever fashion to said form plate, said member extending over a poured concrete material; and (f) a means for suspending said anchor bolts below a level of poured concrete, said means secured to said primary support member, said suspending means including a secondary support element adjustably attached to said primary support member, and at least one support plate adjustably attached to said secondary support element, said support plate defining an opening through which an anchor bolt can pass.

2. The anchor bolt template of claim 1, wherein said secondary support element comprises:

(a) a first cylindrical element attached to said primary support member; and (b) a second cylindrical element arranged parallel to said first cylindrical element and attached to said primary support member, wherein said first cylindrical element and said second cylindrical element span from said first primary support element to said second primary support element.

3. The anchor bolt template of claim 2, further comprising a stabilizing member having a first end joined to the first primary support element and a second end joined to the second primary support element, said stabilizing member giving rigidity to the primary support members.

4. The anchor bolt template of claim 1, wherein said support plate comprises:

(a) a rectangular base unit adjustably attached to said secondary support element and defining said opening.

(b) a cylindrical collar element mounted normally on said base unit adjacent to said opening for supporting said anchor bolt by engaging an anchor bolt nut threaded upon said anchor bolt.

* * * * *